United States Patent [19]

Landers

[11] 4,063,541

[45] Dec. 20, 1977

[54] CARBURETOR PROVIDING A UNIFORMLY ATOMIZED FUEL-AIR MIXTURE

[76] Inventor: Richard D. Landers, P.O. Box 1035, Wichita, Kans. 67201

[21] Appl. No.: 675,493

[22] Filed: Apr. 9, 1976

[51] Int. Cl.[2] ..... F02N 17/08; F02N 17/28; F02N 37/14

[52] U.S. Cl. ..... 123/139 AW; 123/119 R; 123/119 E; 123/DIG. 10; 261/36 A; 261/DIG. 69

[58] Field of Search ..... 123/139 AW, 125, 131, 123/133, 132, 126, 119 R, DIG. 10, 119 E; 261/DIG. 69, 36 A

[56] References Cited

U.S. PATENT DOCUMENTS

| | | | |
|---|---|---|---|
| 890,970 | 6/1908 | Durr | 261/36 A |
| 2,706,976 | 4/1955 | Gianini | 123/139 AW |
| 3,269,658 | 8/1966 | Gerquest | 261/36 A |
| 3,613,649 | 10/1971 | Ilford et al. | 123/119 E |
| 3,616,782 | 11/1971 | Matsui et al. | 123/DIG. 10 |
| 3,864,105 | 2/1975 | Davis | 261/36 A |
| 3,977,382 | 8/1976 | Tuzson et al. | 261/36 A |

FOREIGN PATENT DOCUMENTS

| | | | |
|---|---|---|---|
| 1,214,991 | 12/1970 | United Kingdom | 123/125 |

*Primary Examiner*—Wendell L. Burns
*Attorney, Agent, or Firm*—Eugene D. Farley

[57] ABSTRACT

Carburetor for supplying intermixed air and atomized fuel to an engine comprises an air passageway, having a throttle for passing a controllable amount of atmospheric air, and injection means configured for injecting pressurized fuel into the air passageway in a generally flat spray pattern disposed substantially normal to the air passageway. A bypass chamber is located adjacent to the air passageway, opening thereto for capturing any unimpeded fuel injected by the injection means, returning it to the fuel tank. A metering vane located in the air passageway is configured for allowing passage of substantially all of the fuel into the bypass chamber when there is no airflow in the air passageway and for intercepting a portion of the fuel when the spray pattern is deflected by airflow in the air passageway, directing it into the air passageway. The metering vane is shaped such that the deflected portion of the fuel remains in a predetermined ratio with the airflow over the full range of engine operation.

12 Claims, 6 Drawing Figures

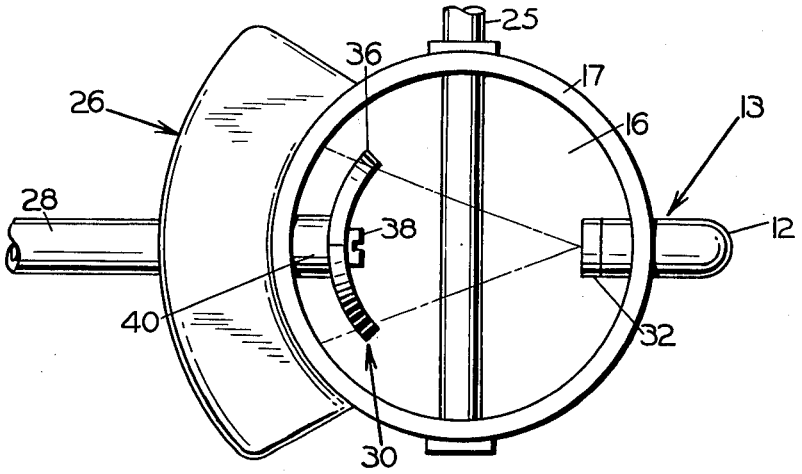
FIG. 2
FIG. 3
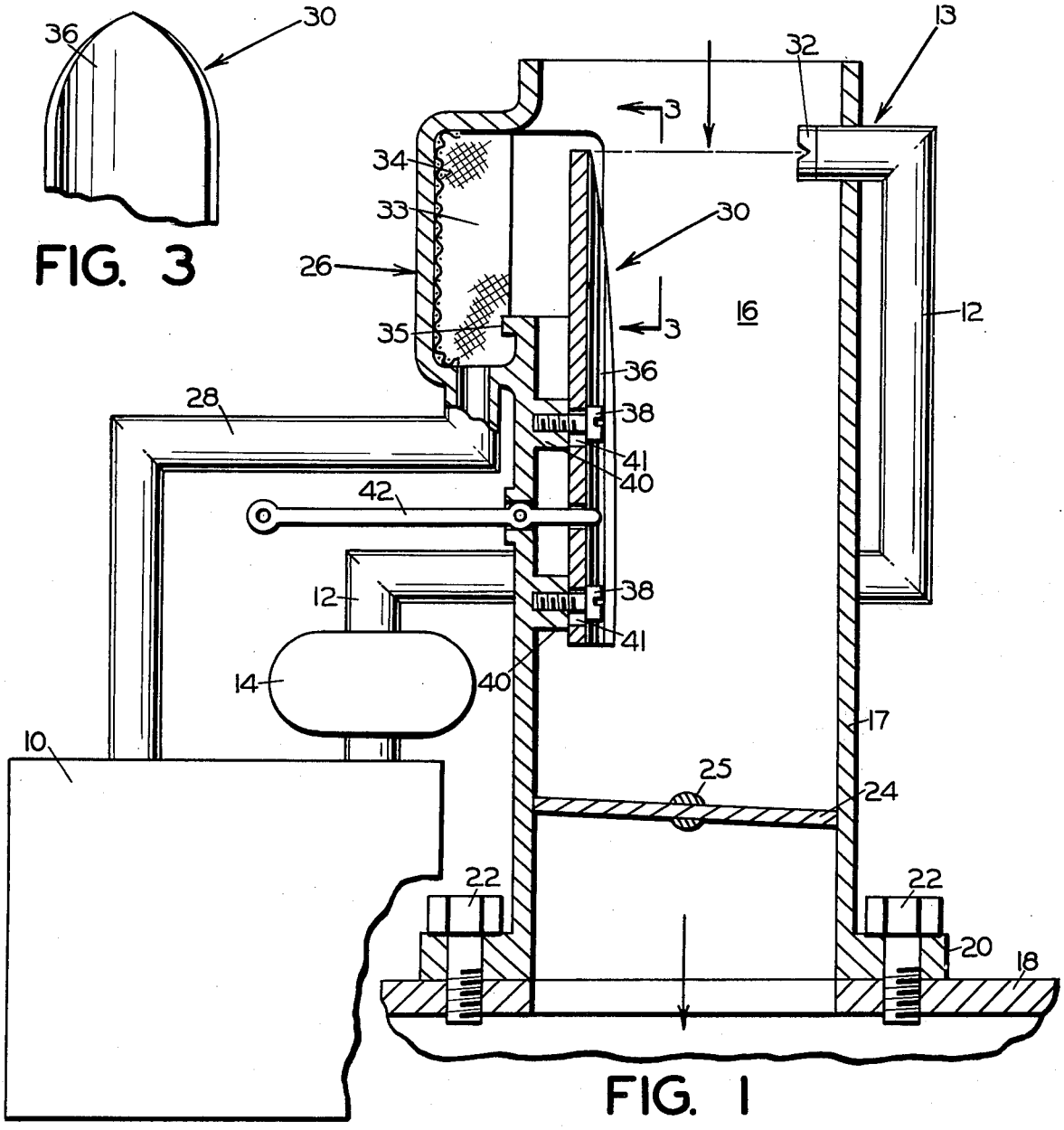
FIG. 1

CARBURETOR PROVIDING A UNIFORMLY ATOMIZED FUEL-AIR MIXTURE

BACKGROUND OF THE INVENTION

This invention relates to a carburetor for use in an air breathing, fuel burning engine. It relates in general to such a carburetor utilizing carburetor airflow for deflecting a stream of fuel injected across the carburetor air passageway allowing diversion of a portion thereof.

The common carburetor of the prior art generally includes a venturi air passageway with associated throttle for controlling the amount of air supplied to the engine. As the air passes through the venturi, a pressure differential is created which is used to draw fuel into the carburetor through jets or similar matering means. At idle, the airflow through the passageway is so low that the pressure differential which is created is insufficient to supply enough fuel. Therefore, additional idle jets are provided for augmenting the main jets when the engine is idling.

Since the fuel is not pressure-injected into the air stream, it generally is atomized poorly and the resulting air-fuel mixture is nonhomogeneous, containing slugs of liquid fuel. This condition is most pronounced at idle when the fuel essentially is dribbled into the engine. As a result the engine runs fuel rich at idle, causing excessive air pollution and poor economy.

Many attempts have been made to correct this problem with prior art carburetors. The most successful approach has been the use of fuel injection means which inject metered amounts of fuel directly into each cylinder responsive to engine requirements. In addition carburetors have been devised which inject metered amounts of pressurized fuel into common air passageways for distribution to the cylinders.

However, these prior art improvements have used control means external to the carburetors or fuel injection systems for determining engine airflow requirements. The amounts of fuel injected then are controlled by the external control means.

The disadvantage with these systems is that the external control means required to meter the fuel necessarily are complex and expensive to construct. In addition, their complexity results in frequent malfunction and costly maintenance and repair.

SUMMARY OF THE INVENTION

In its basic concept the carburetor of this invention involves utilizing carburetor airflow for deflecting a pressurized stream of fuel injected across the carburetor air passageway so that a portion of the fuel may be deflected by a contoured metering vane, supplying the engine with a constant ratio of air and atomized fuel over the full range of engine requirements.

It is by virtue of the foregoing basic concept that the principal object of this invention is achieved; namely, to overcome the aforementioned disadvantages of prior carburetors.

Another important object of this invention is the provision of a carburetor which has the fuel injected therein at a high pressure, enhancing fuel atomization. This permits using a leaner fuel-air ratio, thereby reducing air pollution and increasing economy.

Still another important object of this invention is the provision of a carburetor of simple construction, resulting in high reliability, ease of maintenance and economical manufacture.

The foregoing and other objects and advantages of this invention will appear from the following detailed description taken in conjunction with the accompanying drawings of preferred embodiments.

BRIEF DESCRIPTION OF THE DRAWINGS

FIG. 1 is a cross sectional view in side elevation of a carburetor embodying the features of a first embodiment of this invention, parts being broken away to disclose details of internal construction.

FIG. 2 is a fragmentary plan view of the carburetor shown in FIG. 1.

FIG. 3 is a fragmentary view, in side elevation, looking in the direction of the arrows of line 3—3 in FIG. 1.

DESCRIPTION OF THE PREFERRED EMBODIMENT

Figure 6:
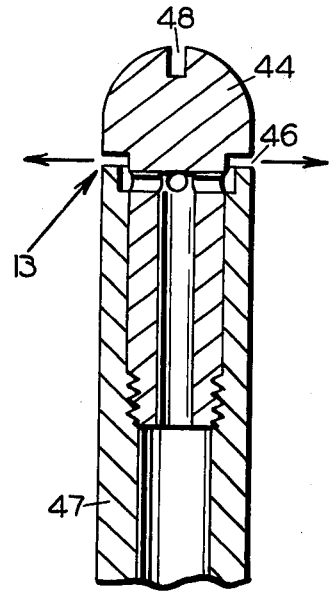
FIG. 6 is a cross sectional view taken on the line 6—6 of FIG. 4.
Figure 5:
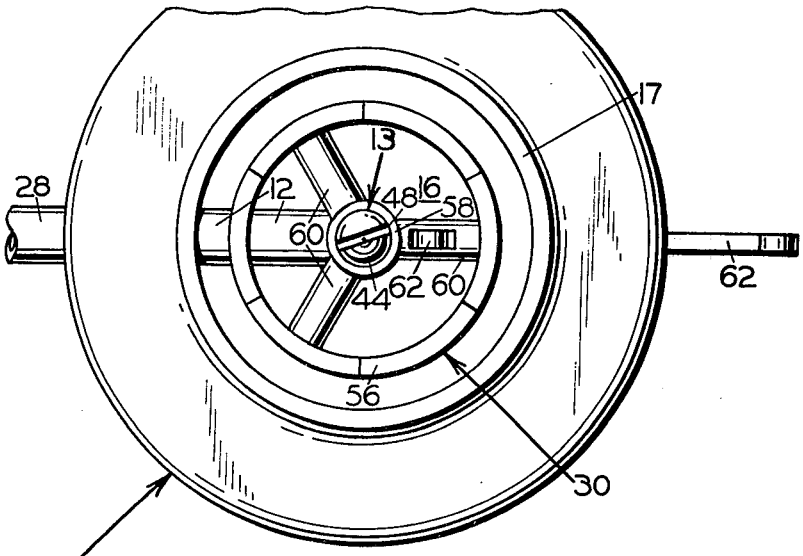
FIG. 5 is a fragmentary plan view of the carburetor shown in FIG. 4.

Referring to the drawings, the carburetor of the present invention is illustrated in two embodiments.

In both embodiments fuel is supplied from an external source, such as tank 10, through a line 12 to injection means 13 located in the carburetor. A pump 14 located in the fuel line pressurizes the fuel.

The carburetor includes an air passageway 16, preferably defined by a cylindrical carburetor body 17. One end of the air passageway is open for receiving atmospheric air and the other end is connected to an engine 18 by means of a flange 20 and bolts 22. Distribution of the fuel to the cylinders of the engine is by means of a standard manifold.

A throttle, such as a butterfly valve 24, is located rotatably in the air passageway near the engine for controlling the amount of airflow through the carburetor. The shaft 25 on which the throttle is carried extends beyond the carburetor body, allowing external control of the throttle position.

A bypass chamber 26 extends from open connection with the air passageway and is interconnected to tank 10 by fuel return line 28. As will be more fully explained later for each of the specific embodiments illustrated, the bypass chamber is located in the air passageway in such a manner that fuel injected from the injection means will be captured in the bypass chamber and returned to the tank unless the fuel spray is impeded.

To this end a metering vane 30 is located in the air passageway in a manner to intercept a portion of the fuel spray from the injection means, when the spray is deflected due to airflow in the air passageway.

Referring now to FIGS. 1, 2 and 3, the first embodiment of the carburetor of the present invention utilizes a spray nozzle 32 in the injection means which is located adjacent the wall of the air passageway. The nozzle is configured to develop a generally flat, fan-shaped spray pattern which extends across the airflow passage, as shown by the dot-dashed lines in FIGS. 1 and 2.

In this embodiment the bypass chamber defines an enlarged bulbous cavity 33 located in the carburetor body across from the spray nozzle. The cavity defines an arc which covers a greater angular portion of the carburetor body than the spray from the nozzle 32. The cavity contains a porous fuel absorbent material 34 such as stainless steel mesh which prevents fuel from splashing off of the cavity wall back into the air passageway. Located at the bottom of the cavity is an inwardly facing lip 35 which prevents further any fuel from being discharged from the bypass chamber back into the air passageway.

The metering vane 30 in this embodiment comprises a thin, arcuate plate 36 covering slightly over one half of the longitudinal extent of the carburetor body and defining an arc sufficient to intersect the fan-shaped spray pattern of nozzle 32 completely. The plate has an arcuate top portion, as best shown in FIG. 3, which is positioned longitudinally in the air passageway at a location slightly below the normal horizontal path of the nozzle spray pattern.

The plate is located near the carburetor body across from nozzle 32 by means of bolts 38. The bolts engage threaded bores in bosses 40 which extend inwardly from the carburetor body, and pass through slots 41 located in the plate. The heads of the bolts do not engage the plate tightly, allowing the plate to be positioned slidably, longitudinally within the air passageway. Linkage 42 which passes through the carburetor body is connected to the plate, allowing its positioning by the operator.

The second embodiment of the invention has the injection means 13 located medially in the air passageway. A circular spray nozzle 44 having a peripheral spray groove 46 for spraying fuel in a flat annular spray pattern outwardly across the air passageway is located on top of vertical extension 47 of the fuel line. A slot 48, for insertion of a screw driver, is located on top of the nozzle for tightening the nozzle in the fuel line extension.

The bypass chamber 26 in this embodiment defines an enlarges cavity 50 similar to cavity 33 except extending around the periphery of the carburetor body 17. The cavity 50 is located across from the spray nozzle 44 and contains a porous fuel absorbent material 52 preventing the fuel from splashing back out of the cavity. Lip 54 located at the bottom of the cavity also prevents fuel from splashing out of the cavity.

Figure 4:
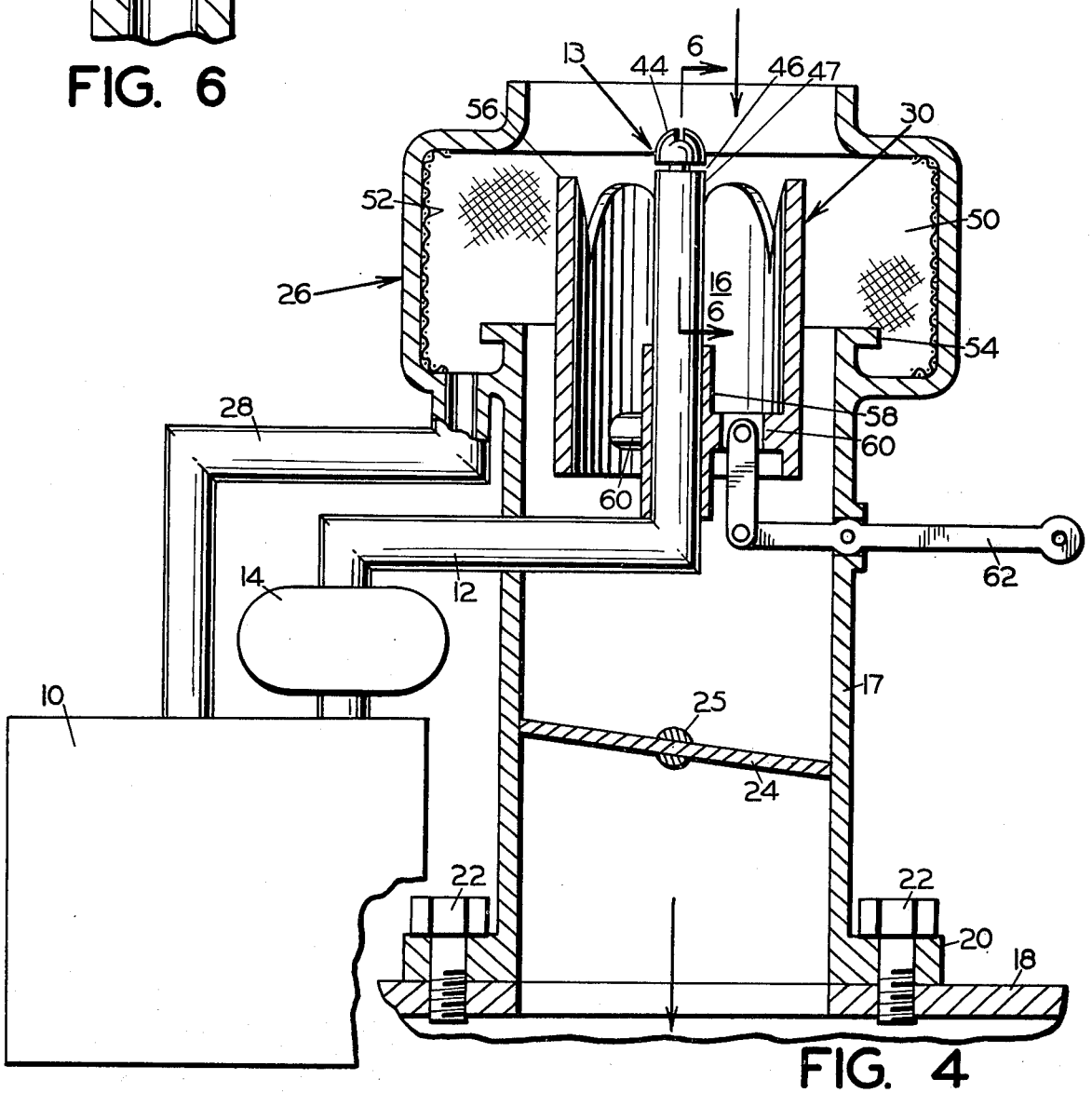
FIG. 4 is a cross sectional view, in side elevation, of a carburetor embodying the features of a second embodiment of this invention, parts being broken away to disclose details of internal construction.

The metering vane 30 in this embodiment comprises a thin cylinder 56 located intermediate the vertical fuel line extension 47 and the carburetor body 17. The cylinder has a scalloped upper end, as best shown in FIG. 4, allowing deflection of a metered portion of the fuel and passage of the rest. The exact dimensions and contour of the scallops depend on the particular airflow characteristics of the carburetor. A sleeve 58 configured for sliding engagement with the fuel line extension 47 is interconnected to the cylinder by means of webs 60.

Linkage 62 connected to the cylinder passes through the carburetor body allowing positioning of the cylinder by the operator.

OPERATION

The operation of both embodiments of the invention essentially is the same. When the engine is not operating, so that there is no airflow through the air passageway 16, all of the fuel sprayed from the injection means 13 passes over the metering vane 30. Thus all of the fuel is returned to the tank and none is passed into the engine.

However, even though no fuel enters the engine a certain small amount is vaporized in the air passageway so that when a low rate of airflow is initiated in the air passageway, as by operating the engine on its starter, there is enough fuel for combustion. When the engine is started, idle airflow through the air passageway causes the fuel spray pattern to be deflected slightly, defining a path in which a small portion strikes the top of the metering vane and is directed down the air passageway to the engine. Due to the arcuate shape of the top of plate 36 of FIG. 1 and the scalloped contour of the cylinder 56 of FIG. 4, most of the fuel still passes over the metering vane and into the bypass chamber for return to the tank.

As the throttle is opened the airflow through the air passageway is increased, further deflecting the spray pattern. Thus the fuel strikes lower on the metering vane allowing passage of a proportionately larger amount to the engine and a smaller amount for return to the tank.

It will be noted that by forming properly the arcuate upper portion of plate 36 or the scalloped portion of cylinder 56, the ratio of air to fuel may be made to remain automatically constant at all engine speeds including idle. It will also be noted that the arcuate upper portion of plate 36 or the scalloped portion of cylinder 56 may provide a richer mixture ratio at certain airflow speeds, if desired, by forming the metering vane wider at those desired airflow speed points. For example, a richer (and potentially more powerful) mixture ratio might be desired during higher speed acceleration as when passing another automobile.

In addition, due to the fact that the fuel always is sprayed from the nozzle at full pressure, the fuel is atomized uniformly at all engine speeds including idle.

If the operator desires to increase the fuel-air ratio, as when starting a cold engine, he may raise the metering vane by means of the interconnecting linkage 42 or 62. In this event a larger portion of the fuel strikes the metering vane at any given level of airflow, causing a richer mixture.

It will be apparent to those skilled in the art that various changes may be made in the size, shape, type, number and arrangement of parts described hereinbefore. For example, while the carburetor is shown as being of the down draft type, the basic concept is adaptable equally to side draft or up draft carburetors. In addition, although embodiments are shown utilizing fuel nozzles providing fan shaped and circular spray patterns, other types of fuel nozzles also can be utilized. These and other modifications may be made as desired without departing from the spirit of this invention.

Having thus described my invention and the manner in which it may be used, I claim:

1. A carburetor for intermixing atomized fuel and air for delivery to an internal combustion engine, comprising:

a. an elongated passageway adapted for communication at one end with the intake of an internal combustion engine and at the opposite end with the atmosphere, b. a throttle valve in the passageway for controlling the amount of air flow therethrough, c. a fuel spray nozzle in the passageway communicating the passageway with a source of fuel under pressure and configured to inject fuel into the passageway in a generally flat spray pattern disposed substantially normal to the longitudinal axis of the passageway, d. a bypass chamber communicating the passageway with the fuel source and arranged to capture any undeflected fuel spray injected into the passageway by the nozzle and return it to the fuel source, and e. a fuel metering vane in the passageway between the nozzle and bypass chamber and arranged to allow fuel spray from the nozzle to enter the bypass chamber when there is no air flow in the passageway and to deflect variable portions of the fuel spray to the passageway by correspondingly variable amounts of air flow in the passageway.

2. The carburetor of claim 1 including means mounting the metering vane for adjustment toward and away from the fuel spray plane of the nozzle for varying the air-fuel ratio.

3. The carburetor of claim 2 including vane operating means engaging the metering vane and extending outwardly of the passageway for manipulation for adjusting the position of the metering vane.

4. The carburetor of claim 1 including a porous fuel absorbing material on the surface of the bypass chamber facing the fuel spray nozzle for preventing fuel from splashing back into the passageway.

5. The carburetor of claim 1 wherein the fuel spray nozzle is located adjacent the wall of the passageway and is configured for delivering a fan-shaped fuel spray pattern substantially across the air passageway, and the metering vane and bypass chamber have widths sifficient to intercept said fan-shaped spray.

6. The carburetor of claim 5 wherein the metering vane is arcuate in cross section.

7. The carburetor of claim 6 wherein the end of the metering vane facing the fuel spray plane of the nozzle is shaped arcuately.

8. The carburetor of claim 1 wherein the nozzle is located substantially on the longitudinal centerline of the passageway and develops an annular fuel spray pattern outwardly therefrom, the bypass chamber is of annular shape and is disposed about the pasageway, and the metering vane is cylindrical in shape and is disposed concentrically between the nozzle and bypass chamber.

9. The carburetor of claim 8 wherein the end portion of the metering vane facing the fuel spray plane of the nozzle is scalloped.

10. The carburetor of claim 8 including means mounting the metering vane for adjustment toward and away from the fuel spray plane of the nozzle, and vane operating means engaging the metering vane and extending outwardly of the passageway for manipulation for adjusting the postion of the metering vane.

11. In a carburetor for intermixing atomized fuel and air, of the type having an air passageway passing air flow and atomized fuel to an engine, a throttle located in the air passageway for controlling the air flow therethrough, and pressurized fuel supplied from an external source, the improvement comprising:

a. injection means located substantially medially in the air passageway and configured for developing an annular spray pattern outwardly across the air passageway, b. a bypass chamber located adjacent to the air passageway, open thereto, and configured for capturing any unimpeded fuel injected by the injection means and for returning it to the fuel source, and c. a cylindrical metering vane mounted intermediate the injection means and the wall of the air passageway and configured for allowing passage of the fuel from the injection means to the bypass chamber when there is no air flow in the air passageway, and for intercepting a portion of the fuel when the fuel spray pattern is deflected due to flow in the air passageway and directing the deflected portion into the air passageway for intermixing with the air, the end portion of the metering vane facing away from the engine being scalloped, d. the metering vane being configured for intercepting an amount of fuel proportional to the air flow in the air passageway for maintaining a predetermined air-fuel ratio to the engine.

12. The carburetor of claim 11 including mounting means slidably mounting the metering vane in the caburetor allowing its longitudinal movement inthe air passageway, and a linkage connected to the metering vane and passing through the carburetor, in a manner allowing movement of the metering vane longitudinally upon the manipulation of the linkage.

* * * * *